United States Patent [19]

Eddy et al.

[11] 4,036,508

[45] July 19, 1977

[54] SELF-PROPELLED DRILLING AND WORKOVER RIG

[75] Inventors: Kenneth Harmon Eddy; Kenneth Harmon McGill, both of Beaumont, Tex.

[73] Assignee: Dresser Industries, Inc., Dallas, Tex.

[21] Appl. No.: 526,645

[22] Filed: Nov. 25, 1974

[51] Int. Cl.[2] ..... B60D 7/02

[52] U.S. Cl. ..... 280/492; 280/404; 212/46 R; 180/53 R; 254/139.1

[58] Field of Search ..... 254/166, 139.1; 173/28, 173/25; 52/118, 148, 116; 175/85 R, 154; 280/494, 504, 492, 423 A, 425 A, 423 R, 437; 212/46 R; 180/53 R; 214/506

[56] References Cited

U.S. PATENT DOCUMENTS

| | | | |
|---|---|---|---|
| 1,590,582 | 6/1926 | Johnson et al. | 280/492 |
| 1,935,811 | 11/1933 | Metcalf | 180/53 R |
| 2,126,597 | 8/1938 | Zeilman | 212/46 R |
| 2,221,278 | 11/1940 | Utterback | 280/492 |
| 2,334,312 | 11/1943 | Caldwell | 173/25 |
| 2,343,517 | 3/1944 | Alexander et al. | 173/25 |
| 2,583,958 | 1/1952 | Moon | 212/46 R |
| 2,761,268 | 9/1956 | Johnson | 180/53 R |
| 2,871,030 | 1/1959 | Hollis | 280/492 |
| 2,948,511 | 8/1960 | Wilson | 254/139.1 |
| 3,037,792 | 6/1962 | Colpo | 280/438 A |
| 3,087,744 | 4/1963 | Tanenbaum | 280/404 |
| 3,101,816 | 8/1963 | Fox | 254/139.1 |
| 3,141,654 | 7/1964 | Bergerson et al. | 254/139.1 |
| 3,180,080 | 4/1965 | Budzich et al. | 180/53 R |
| 3,201,091 | 8/1965 | Woolslayer et al. | 254/139.1 |
| 3,209,850 | 10/1965 | Fish | 180/53 R |
| 3,212,595 | 10/1965 | Mathews et al. | 280/492 |
| 3,224,597 | 12/1965 | Whitmire | 254/139.1 |
| 3,751,070 | 8/1973 | Schaffart et al. | 280/438 A |
| 3,778,087 | 12/1973 | Kallenbach | 280/492 |

*Primary Examiner*—Albert J. Makay
*Assistant Examiner*—Kenneth Noland
*Attorney, Agent, or Firm*—Michael J. Caddell

[57] ABSTRACT

An articulated self-propelled drilling and workover rig capable of using and racking three-joint sections of drillpipe and featuring high mobility and ease of setup utilizes an hydraulically actuated telescoping mast mounted on a tandem rig with the power supply mounted on a tractor and arranged to alternately propel the rig on the highway and power the drawworks at the drilling site.

2 Claims, 5 Drawing Figures

SELF-PROPELLED DRILLING AND WORKOVER RIG

BACKGROUND OF THE INVENTION

This invention is directed to drilling rigs and specifically involves a highly mobile back-in type self-propelled rig which has the capability of transporting a telescoping mast which is tall enough to pull and rack sections of drillpipe in three-joint lengths.

Standard drillpipe normally is manufactured in thirty foot joints and there are mobile drilling rigs available in the art which are capable of handling drillpipe sections two-joints in length. These involve the single trailer rig, the double trailer rig, and the truck mounted rig. With the single trailer rig, a semi-trailer is utilized to carry the entire rig apparatus including the telescoping mast, the drawworks, and the power supply. Due to highway weight limitations on the amount of weight allowed per set of axles, the largest mast that may be utilized on a single trailer rig can only handle drillpipe in two-joint lengths. The same is true for the truck mounted rig which uses a single extended truck chassis to transport the rig components.

The double trailer rig utilizes one trailer to carry the mast and accompanying equipment and a second trailer to carry the engines and drawworks. The dual trailer rig uses two trucks to pull the trailers and actually comprises two truck-trailer combinations.

Neither the single trailer rig nor the truck mounted rig can carry a mast large enough to pull three-joints or ninety feet of drillpipe at a time due to the legal weight limitations on the axles. The dual trailer rig may be capable of carrying a large enough mast but essentially requires two separate vehicles to transport it.

The present invention provides a single portable vehicular rig having a mast-carrying capability sufficient to legally transport a mast which can handle three-joint sections of drillpipe. This is particularly advantageous because of the fast rig operation resulting from the ability to handle three-joint sections of drillpipe rather than only the two-joint sections to which the prior devices are limited. This results in a reduction of approximately 33 percent in the number of times the drillpipe joints have to be made-up or broken out when going in or coming out of the hole. This is achieved by using a jointed or articulated self-propelled rig with a unique swivel joint which allows three sets of axles to distribute the weight, as opposed to the two sets of axles on the prior rig vehicles.

DESCRIPTION OF THE PREFERRED EMBODIMENTS

Figure 1:
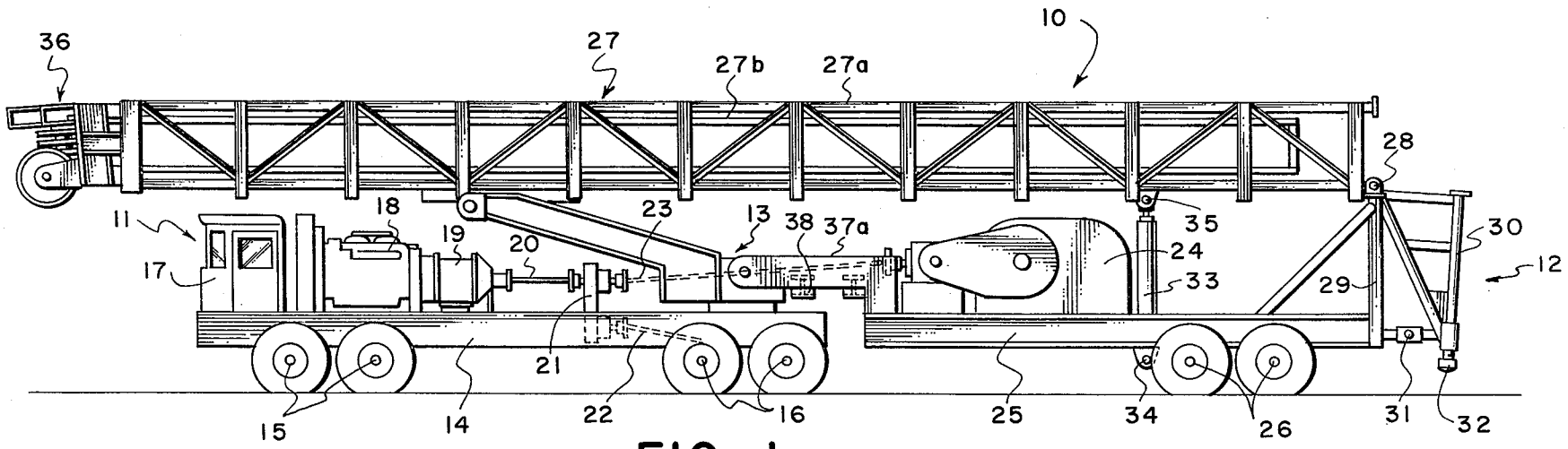
FIG. 1 is a side view of the drilling rig of this invention.
Figure 2:
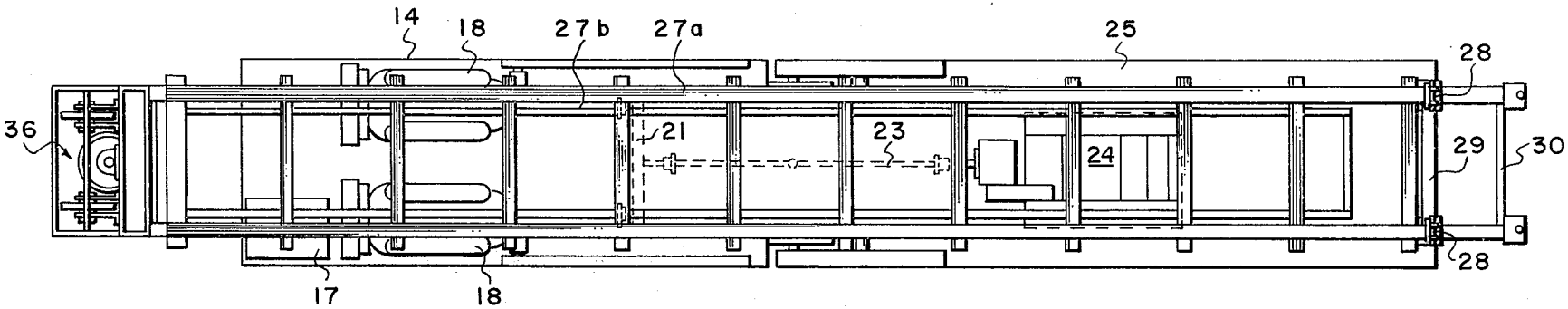
FIG. 2 is a top view of the mast area of the rig of FIG. 1.

In FIGS. 1 and 2, the rig 10 is illustrated comprising a power vehicle 11 and a tandem vehicle 12. The two vehicles 11 and 12 are joined by an articulated swivel joint assembly 13 which is illustrated in closer detail in FIGS. 3 and 4.

The power vehicle or tractor rig 11 utilizes a frame assembly 14 having a front axle set 15 and an intermediate set of drive axles 16. In this embodiment, the front and intermediate axle sets each have two axles. The frame assembly 14 is mounted on the axle sets 15 and 16 and has an operator's cab 17 mounted forward on the frame. Directly behind the cab 17 are the prime movers 18 mounted on the frame assembly. The present embodiment is illustrated with two prime movers but any number from one up could be utilized, limited only by the physical size of the tractor unit 11. The prime movers, which can be internal combustion engines, turbines, electric motors, etc., each transfer power through a transmission and clutch assembly 19 and propeller shaft 20 to a compound 21 where the power of the multiple engines is combined and directed either to motive power for the drive axles 16 by means of shaft 22, or to the drawworks assembly 24 by means of shaft 23. Shafts 20, 22, and 23 are functionally connected to their respective units at each end by flexible couplings allowing limited angular movement of the shafts without malfunction of the equipment associated therewith.

The tandem unit 12 comprises a frame assembly 25 mounted on the rear axle set 26 which also utilizes two axles. As previously mentioned, the drawworks 24 is mounted on the frame 25 of the tandem unit and is connected to the power supply by propeller shaft 23.

A telescoping mast 27 having an outer base section 27*a* and an upper inner section 27b telescoped within the outer section is pivotally mounted at 28 to a hinge support assembly 29 fixedly secured at the end of frame 25. An adjustable y-base assembly 30 is also pivotally attached at 28 and by means of adjustable links 31 to the permanent structure 29.

Adjustable legs 32 are provided on structure 30, which legs may be adjusted upward when the rig is to be moved, and are moved downward to contact the ground at the drilling or workover site.

A pair of hydraulic rams 33 are pivotally attached to the tandem frame at 34 and pivotally attached to the mast base section at 35 to provide raising force for erecting the mast to a vertical position. Alternately, for safety reasons, multistage hydraulic lifting ram systems may be utilized to erect the mast, with the final stage being a double-acting ram for positively controlling the mast as it passes over the center of gravity during raising and lowering operations.

Once the mast assembly 27 is raised to a vertical position, the upper mast section 27*b* carrying the crown block 36 is telescoped upward out of the lower mast 27*a* either by wireline or hydraulic acutation, both of which methods are widely known in art.

FIG. 2 is a partial top view of the rig showing the mast sections 27*a* and 27*b*, the prime movers 18, the drawworks 24, and in phantom, the propeller drive assembly 23 from the compound 21 to the drawworks.

Figure 3:
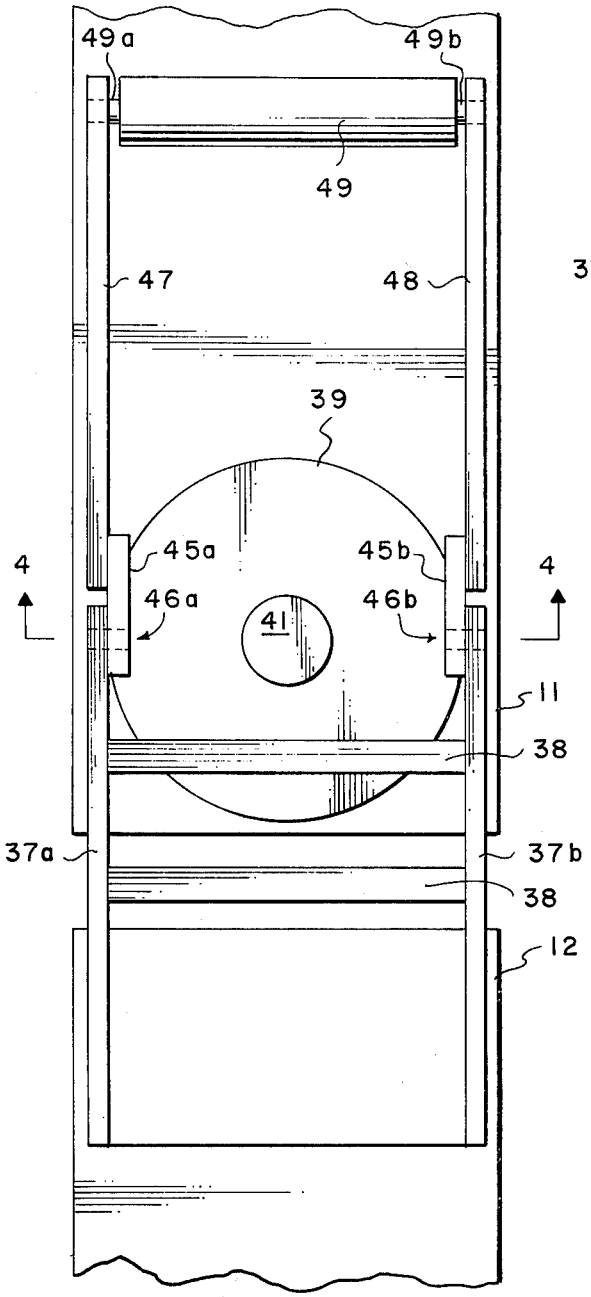
FIG. 3 is a top view of the rig swivel connection.
Figure 4:
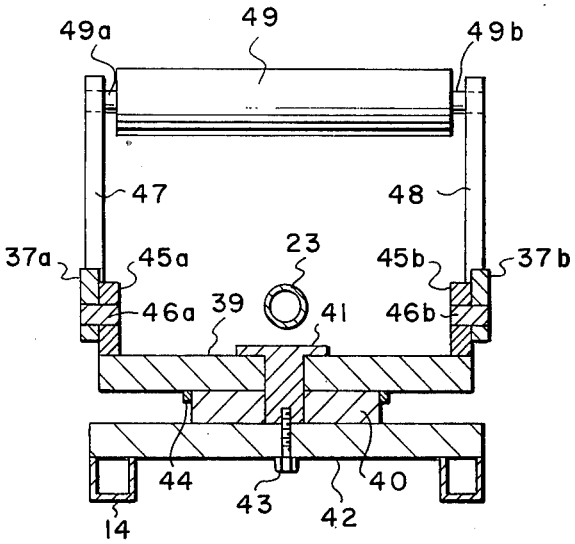
FIG. 4 is a partial cutaway end view of the rig section of FIG. 3.

FIGS. 3 and 4 illustrate in more detail the rig pivot mechanism 13 which allows the use of an articulated vehicle with three sets of axles to support a telescoping mast structure capable of handling three-joint sections of pipe. FIG. 3 is a top view of the central portion of the rig with the mast removed to show the pivot mechanism as it joins the power and tandem vehicles 11 and 12. A pair of parallel, spaced forward arms 37a and 37b are securedly attached to the front portion of the tandem vehicle 12 and are raised sufficiently to extend over the rear end of the power vehicle 11 (see also FIG. 1).

One or more crossmember braces 38 extend across from arm 37*a* to arm 37*b* to strengthen and stiffen the arms.

Referring now to FIG. 4 as well as FIG. 3, a circular bearing plate 39 is rotatably mounted on a bearing base 40 and held in rotatable relationship thereon by flanged pin 41. Base 40 is secured to the bed 42 of power vehicle 11 by welding, bolting, or other known means, and pin 41 may likewise be secured to bed 42 by means such as a threaded bolt 43.

To aid in aligning plate 39 with base 40 so that pivot pin 41 may be easily passd downward through both sections, a circular guide ring 44 slightly larger in diameter than the circular base 40, may be welded in the proper position on the underside of plate 39. This forms a shallow dish effect on the underside of plate 39 to receive base 40 and automatically aligns the pin opening in plate 39 with the pin opening of base 40.

A pair of vertical support tabs 44*a* and 44*b* are securedly attached in diametrically opposed positions to the outer portion of plate 39 by means such as welding.

Arms 37a and 37b are rotatably supported by tabs 45*a* and 45*b* by means of cylindrical pins a46*a* and 46*b* passing through the arms and tabs in relatively close-fitting rotatable relationship.

A pair of parallel extended headrest arms 47 and 48 are fixedly secured by means such as welding to tabs 45*a* and 45*b* and extend forward and upward therefrom at an angle with frame 14 of from about 10° up to around 45° or more.

The headrest comprises a cylindrical roller 49 mounted between the upper ends of arms 47 and 48 by lateral pins 49*a* and 49*b* which are rotatably held in circular openings through arms 47 and 48. Alternatively, roller 49 may be held between arms 47 and 48 by a single cylindrical rod extending axially through roller 49 and arms 47 and 48.

The headrest design is a particularly advantageous feature of the invention. It is clear from the description of this apparatus that the headrest may be considered actually as a third interdependent functional element of the entire rig assembly. The headrest moves with respect to both the tractor unit 11 and the tandem unit 12 to provide the necessary moving support for the mast 27.

For instance, the headrest moves laterally with respect to the tractor unit 11 as the tandem unit moves laterally. This allows the headrest to swing out left or right so as to remain under the mast as the tractor unit 11 pivots with respect to the tandem unit. The headrest is laterally stationary with respect to the tandem unit as is the mast assembly. Thus, the mast and headrest maintain constant alignment with one another, providing continuous support for the mast.

Secondly, the headrest is vertically stationary with respect to the tractor unit to maintain proper clearance between the mast and the tractor cab 17. The headrest is designed to allow vertical movement of the tandem unit with respect to the headrest. Since the mast is attached to the tandem unit, vertical pivoting of the rig when traveling over non-flat terrain is translated into a sliding and levering of the mast about roller 49, much the same way as a child's seesaw operates. Thus, it is shown how the headrest assembly moves laterally with respect to one section of the rig vehicle and vertically with respect to the other section of the rig vehicle.

In FIG. 4, the location of shaft 23 is shown to illustrate the open area through the pivot joint which allows freedom of movement of the shaft 23 with respect to the rig components.

Figure 5:
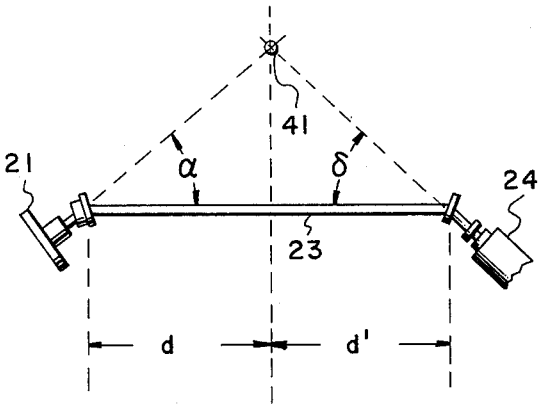
FIG. 5 is a schematic drawing illustrating the angular position of the propeller shaft.

FIG. 5 is a schematic layout of the propeller shaft 23 and its connective components, compound 21 and drawworks 24. In FIG. 5, the rig components are oriented as they would be if the rig were traversing a tight turn to the left. As can be seen, the shaft length and location are chosen so that with misalignment to the right or left the shaft is equidistant and equiangular with respect to the pivot center 41, the coupling at compound 21 and the coupling at the compound 24. The distances d and d′ from the center of rotation at 41 to the respective couplings, projected on shaft 23, remains equal during any turning or misalignment of vehicle 11 with vehicle 12. Also angles $\alpha$ and $\delta$ remain equal during such misalignment.

This is particularly advantageous in that it allows the rig to be misaligned at the drilling site while retaining normal operation of the power system and drawworks through shaft 23. Vertical misalignments are also accounted for with this arrangement in addition to the lateral misalignment illustrated.

OPERATION AND ADVANTAGES OF THE EMBODIMENTS

In typical operation, the rig 10 may be assembled by securing the drawworks 24 to the tandem vehicle 12 by suitable attachment means known in the art. Plate 39, having tabs 45a and 45b, arms 47 and 48 and headrest 49, is lowered onto base plate 40 on power vehicle 11 and positioned thereon by locating ring 44 around plate 40, thereby aligning the center holes through the plates. The flanged pin 41 is then pushed through the center holes until the flange is abutting plate 39. The bolt 43 may then be passed through a hole in bed 42 and threaded into pin 41 thereby retaining the pin in place.

The power vehicle and tandem vehicle may then be joined together by aligning arms 37*a* and 37*b* of the tandem vehicle with tabs 45*a* and 45*b* of the power vehicle, then inserting hinge pins 46*a* and 46*b* through the arms and tabs. The mast 27 may then be lowered onto the rig and attached at pivot points 28 and 35 with the forward portion on roller 49.

A majority of the mast weight clearly is supported by the intermediate axles 16, while a lesser portion of the mast weight and the weight of the drawworks is supported by the rear axles 26. The front axles 15 support the cab 17 and most of the weight of the power engines 18.

Movement of the rig over uneven terrain is possible by the flexing of articulated joint 13. Lateral rotation is handled by the rotation of plate 39 on base 40 about the center pin 41. Vertical flexing is achieved about lateral pins 46*a* and 46*b* and occurs between arms 37*a* and 37 *b* and tabs 45*a* and 45 *b* of plate 39. Flexible couplings at each end of shaft 23 allow vertical and horizontal misalignment of the power drive line assembly while the rig is operating on site.

The weight of the entire rig is spread out fairly evenly over three sets of axles while retaining the singular vehicle concept by means of the articulated joint 13. This provides a mastcarrying capacity large enough to transport an extendable mast which can handle three-joint sections of drillpipe.

Although a specific preferred embodiment of the present invention has been described in the detailed description above, the description is not intended to limit the invention to the particular forms or embodiments disclosed herein, since they are to be recognized as illustrative rather than restrictive and it will be obvious to those skilled in the art that the invention is not so limited. For instance, whereas two prime movers are illustrated, it is obvious that one, three, or even four or more could be utilized. The prime movers may be coupled to the drive axles and drawworks by either gear compounds or chain compounds and propeller shafts, and various types of clutches may be used with the compounds and drawworks such as air, electric, and hydraulic clutches. Thus, this invention is declared to cover all changes and modifications of the specific example of the invention herein disclosed for purposes of illustration, which do not constitute departures from the spirit and scope of the invention.

The embodiments of the invention in which an exclusive property or privilege is claimed are defined as follows:

1. Self-propelled articulated mobile drilling apparatus transportable over uneven terrain to a remote drilling site, said apparatus comprising:

a power vehicle having front and rear axle sets thereon;

power generating means on said power vehicle adapted to propel said power vehicle;

a tandem vehicle attached to said power vehicle and having an axle set and a drawworks thereon;

rotatable compound attachment means attaching said tandem vehicle to said power vehicle and arranged to allow vertical and horizontal swivel movement simultaneously between said two vehicles;

a drilling mast structure carried on said tandem vehicle; and, power transfer means on said two vehicles adapted to transfer power from said generating means to said drawworks wherein said attachment means further comprises:

base plate means on said power vehicle;

table means rotatably mounted on said plate means and attached thereto;

elongated support means attached to said tandem vehicle an extending over said table means;

rotatable attachment means between said support means and said table means arranged to provide vertical flexing of said support means on said table means; and, headrest means attached to said plate means and extending over said power vehicle; said headrest means arranged to support a mast structure extending from said tandem vehicle.

2. An articulated mobile drilling rig comprising:

a tractor vehicle having front and rear axle means;

power generating means on said tractor vehicle;

trailer means pivotally connected to said tractor vehicle and having rear axle means thereon;

a telescoping drilling mast pivotally connected to said trailer means and extending generally laterally forward thereover, said mast adapted to handle ninety foot sections of drillpipe and arranged to be moved from a lateral position to a vertical position;

support means on said drilling rig for supporting said mast in said lateral position;

drawworks mounted on said trailer means in coacting relationship with said mast;

power transfer means on said tractor vehicle, having input means connected to said power generating means and output means connected to said drawworks and at least one of said tractor vehicle axle means;

means for pivotally connecting said trailer means to said tractor means, said attachment means having vertical pivot pin means for allowing lateral pivoting of said rig components, and lateral pivot pin means for allowing vertical pivoting of said drilling rig components; and, wherein said power generating means comprises internal combustion engine means; said power transfer means comprises a gear box and propeller shaft means connected in driving relationship to said tractor rear axle means; and, said support means comprises elongated arms fixedly secured to said attachment means and being only laterally pivotable therewith and roller means held rotatably in said arm means and arranged to receive said mast thereon.

* * * * *